US012692064B2

(12) United States Patent
Sato et al.

(10) Patent No.: US 12,692,064 B2
(45) Date of Patent: Jul. 28, 2026

(54) CUSHIONING STRUCTURE FOR PACKED OBJECT

(71) Applicant: SUZUKI MOTOR CORPORATION, Hamamatsu (JP)

(72) Inventors: Atsushi Sato, Hamamatsu (JP); Wataru Karasudani, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 19/020,088

(22) Filed: Jan. 14, 2025

(65) Prior Publication Data

US 2025/0296758 A1 Sep. 25, 2025

(30) Foreign Application Priority Data

Mar. 22, 2024 (JP) ..... 2024-046779

(51) Int. Cl.
*B65D 81/113* (2006.01)
*B65D 81/107* (2006.01)
(Continued)

(52) U.S. Cl.
CPC ..... *B65D 81/113* (2013.01); *B65D 81/107* (2013.01); *B65D 85/68* (2013.01);
(Continued)

(58) Field of Classification Search
USPC ..... 220/668; 206/320
See application file for complete search history.

(56) References Cited

U.S. PATENT DOCUMENTS 1,368,606 A * 2/1921 Cole ..... B65D 9/22 206/319
3,006,462 A * 10/1961 Boeye ..... B65D 5/5095 206/319
3,701,465 A * 10/1972 Richter ..... B65D 81/056 206/521

FOREIGN PATENT DOCUMENTS

DE 102006046077 B3 * 1/2008 ..... B65D 81/07
JP H 10-250768 A 9/1998
(Continued)

OTHER PUBLICATIONS

Extended European Search Report mailed Jun. 26, 2025, issued in counterpart European Application No. 25152710.7.

*Primary Examiner* — Mollie Impink
(74) *Attorney, Agent, or Firm* — Stein IP, LLC

(57) ABSTRACT

A cushioning structure for protecting a packed object is disposed inside a crate part of a packing frame surrounding a packed object, the cushioning structure being provided to protect the packed object secured on an inner bottom of the packing frame, the cushioning structure including: a first cushioning member made of a foam material disposed adjacent to a side of the packed object; a second cushioning member including a corrugated board assembly that supports the first cushioning member; a base part made of corrugated paper that is located to overlap the inner sides of at least parts of two adjacent vertical frames among a plurality of vertical frames constituting the crate part of the packing frame, and is joined with the bottom of the second cushioning member supporting the first cushioning member; and an anchor part made of corrugated paper that is projected on the back side of the base part and is fit between the two vertical frames.

6 Claims, 8 Drawing Sheets

(51) Int. Cl.
*B65D 85/68* (2006.01)
*B65D 61/00* (2006.01)

(52) U.S. Cl.
CPC ..... *B65D 61/00* (2013.01); *B65D 2581/053* (2013.01); *B65D 2581/055* (2013.01); *B65D 2585/6877* (2013.01)

(56) References Cited

FOREIGN PATENT DOCUMENTS

| | | | | |
|---|---|---|---|---|
| TW | 201326005 | A1 | 7/2013 | |
| WO | WO-2019106869 | A1 * | 6/2019 | ..... B65D 19/44 |

* cited by examiner

CUSHIONING STRUCTURE FOR PACKED OBJECT

CROSS-REFERENCE TO RELATED APPLICATIONS

This application claims the benefit of Japanese Patent Application No. 2024-046779 filed on Mar. 22, 2024, in the Japanese Patent Office. All disclosures of the document named above are incorporated herein by reference.

TECHNICAL FIELD

The present invention relates to a cushioning structure for protecting a packed object.

BACKGROUND ART

When industrial products or the like are transported to a remote destination (e.g., overseas) by using a shipping container or the like, a packing structure is adopted in which the products are secured in a packing frame to be protected from vibration and shocks during transportation.

For example, Patent Literature 1 discloses a packing structure in which an outboard motor placed horizontally is sandwiched between polystyrene foam pads from above and below and is secured on a wooden skid with square posts and angled paper tubes. This packing structure is aimed at lightweight and compact outboard motors, but is not usable for medium-sized or large-sized outboard motors. Furthermore, the packing structure is not strong enough to withstand multi-level stacking despite the flat packing shape, resulting in poor loading efficiency. In addition, the packing structure is based on a configuration that receives a load with a wide pad to distribute the load. This may lead to greater use of polystyrene foam, which will become industrial waste.

In the case of outboard motors, particularly medium-sized or larger outboard motors, a packing form is adopted in which an outboard motor in an upright position with its propulsion direction facing downwards is bolted and stored on a stand erected on the inner bottom of the packing frame, by using a stern bracket as a structure for securing the outboard motor to a hull.

In this packing form, no support structure is practically provided for the packing frame other than the stern bracket, and the outboard motor is supported inside the packing frame in an overhanging state on both sides of the stand. Moreover, the center of gravity is placed high relative to the support position and is biased toward the engine. Therefore, when an impact is applied due to an external factor during loading and unloading operations or transportation, the outboard motor, which is a packed object, may swing and come into contact with the packing frame. Thus, in order to avoid damage caused by contact, a cushioning material such as polystyrene foam is also used.

In addition, final products such as outboard motors are transported to a delivery destination in a packed state. Thus, the packing frame is basically a one-way packing material. In order to reduce additional cost, the packing frame is designed to have minimum strength and rigidity required for ordinary loading and unloading operations and transportation. For this reason, when a large impact occurs due to an external factor, in particular, the packing frame topples over, the cushioning material including polystyrene foam may fail to absorb the impact and may break, leading to damage to the outboard motor that is the packed object.

CITATION LIST

Patent Literature

[Patent Literature 1] JP H10-250768 A

SUMMARY OF INVENTION

Problem to be Solved by the Invention

The present invention has been devised in view of such circumstances. An object of the present invention is to provide a cushioning structure for protecting a packed object, the cushioning structure being designed to have an excellent cushioning effect with a small form and advantageously reduce industrial waste.

Means for Solving the Problem

In order to solve the problem, the present invention is a cushioning structure disposed inside a crate part of a packing frame surrounding a packed object, the cushioning structure being provided to protect the packed object secured on an inner bottom of the packing frame, the cushioning structure including: a first cushioning member made of a foam material having a front face disposed adjacent to a side of the packed object;

a second cushioning member including a corrugated board assembly that supports the first cushioning member while being in contact with the back side of the first cushioning member;

a base part made of corrugated paper that is located to overlap the inner sides of at least parts of two adjacent vertical frames among a plurality of vertical frames constituting the crate part of the packing frame, and has a front face to which the bottom of the second cushioning member supporting the first cushioning member is joined; and an anchor part made of corrugated paper that is projected on the back side of the base part and is fit between the two vertical frames to fix the base part to the crate part.

Advantageous Effect of Invention

According to the cushioning structure of the present invention configured thus, when a large impact is applied by an external factor, an impact load applied from the packed object to the cushioning structure is reduced by elastic deformation of the first cushioning member made of a foam material and is absorbed by plastic deformation of the second cushioning member including a corrugated board assembly, and the base part and the anchor part act as a third cushioning member, thereby obtaining an excellent cushioning effect. Furthermore, as compared with a case in which a cushioning structure is entirely made of a foam material, the present invention can reduce the amount of foam material used, which becomes industrial waste after use.

MODE FOR CARRYING OUT THE INVENTION

Embodiments according to the present invention will be specifically described below with reference to the accompanying drawings.

Figure 1:
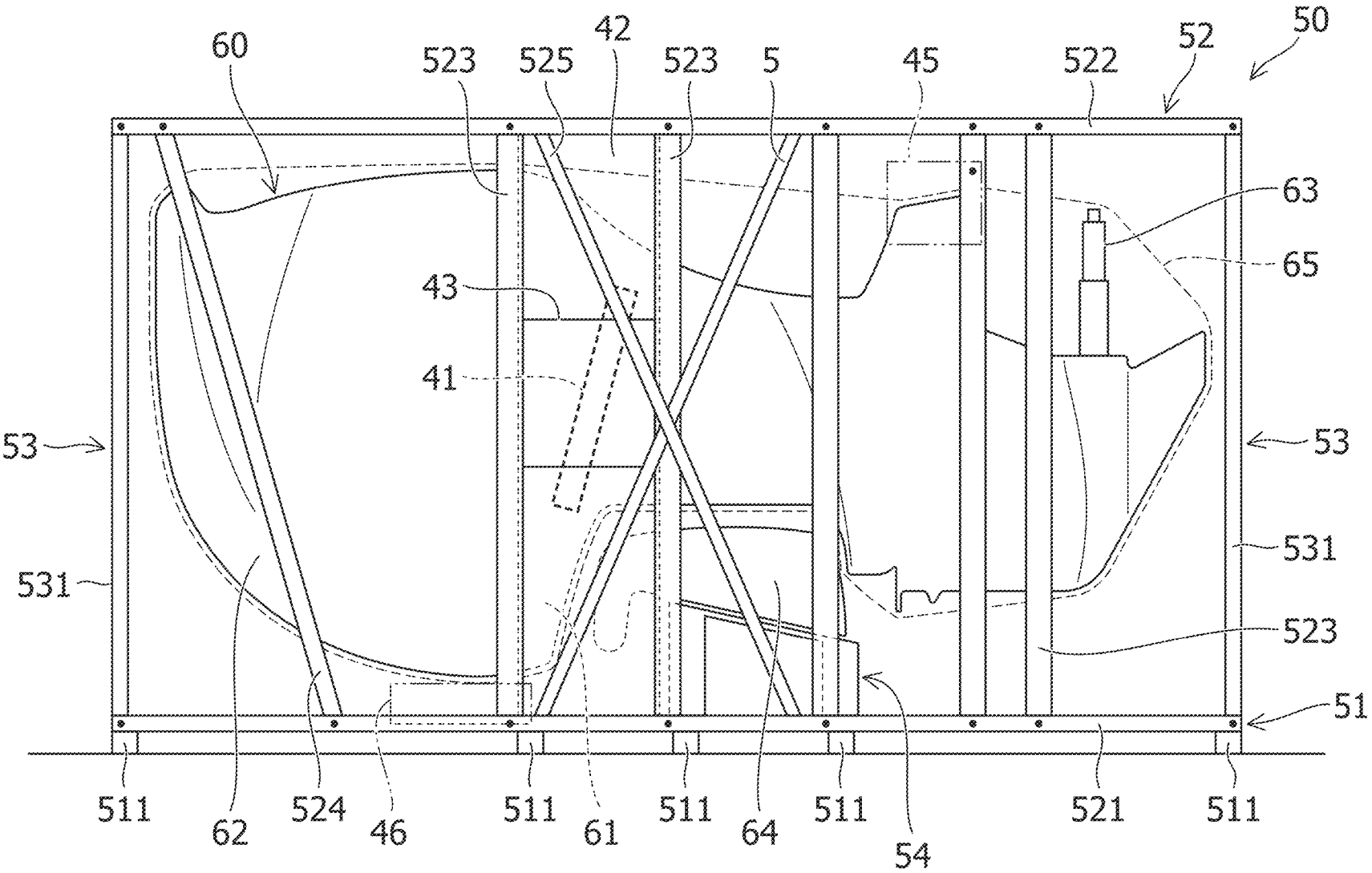
FIG. 1 is a front view illustrating a packing structure for an outboard motor.
Figure 2:
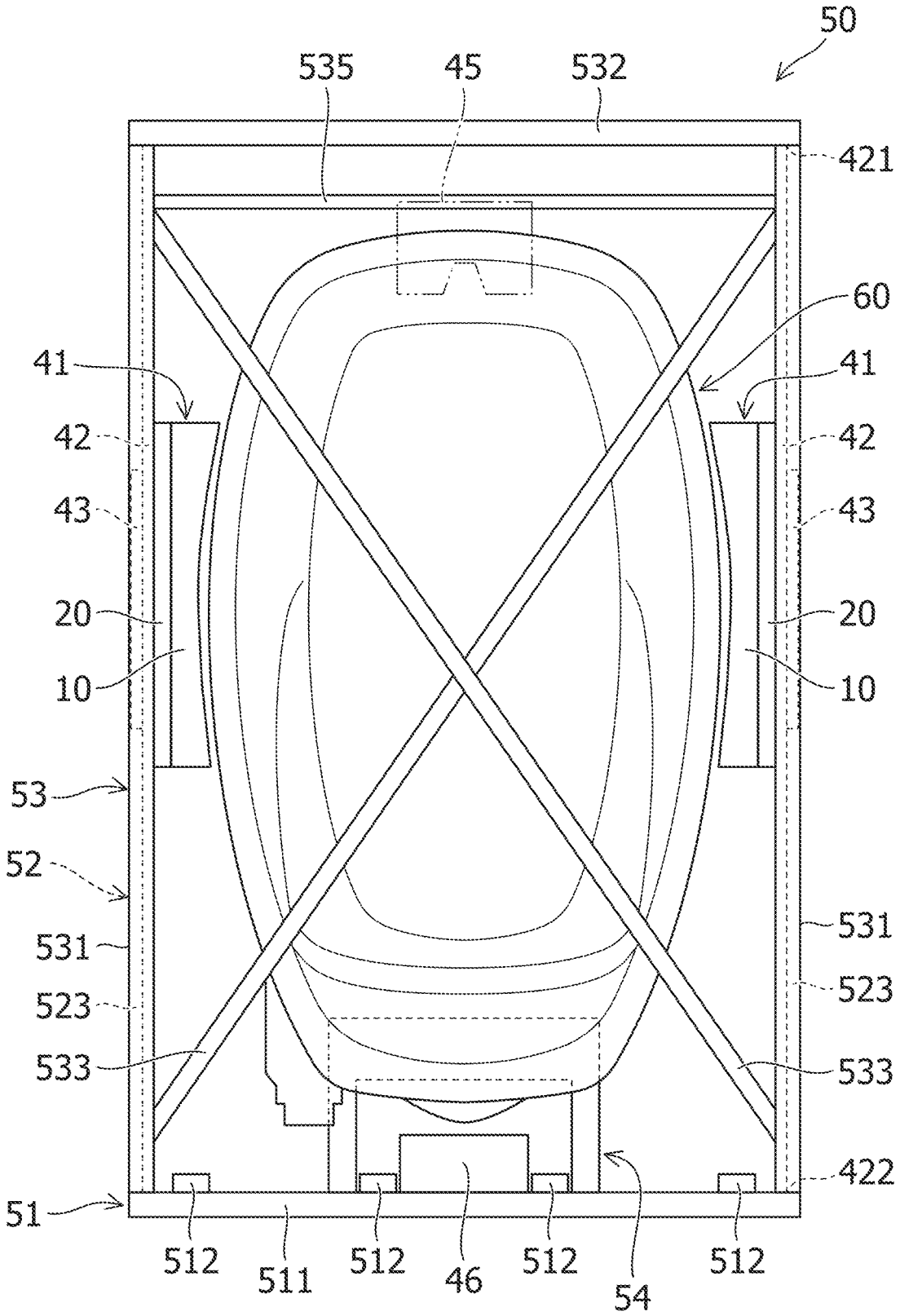
FIG. 2 is a side view illustrating the packing structure for the outboard motor.

FIGS. 1 and 2 illustrate a packing structure in which an outboard motor 60 serving as a packed object is secured and stored in a packing frame 50. The packing frame 50 includes a bottom frame 51 constituting a skid and side frames 52 and end frames 53 that constitute a crate part around the bottom frame 51. A stand 54 is erected nearly at the center of the bottom frame 51.

The outboard motor 60 is secured on a stand 54 in an upright position with its propulsion direction facing downwards by bolting a stern bracket 64 placed on the stand 54. A propeller (not illustrated) has been removed from a propeller shaft 63 and is packed with a sheet 65 (e.g., a plastic film) in this state.

Subsequently, the lower part (521) of the side frame 52 is fixed to each of the long sides of the bottom frame 51 with bolts, the lower end of the end frame 53 is fixed to each of the short sides of the bottom frame 51 with bolts, the side frame 52 and the end frame 53 are joined to each other with bolts, and the upper parts of the opposed side frames 52 are connected via a reinforcing frame (not illustrated), which constitutes the crate part surrounding the outboard motor 60. Thereafter, the packing frame 50 is covered with a corrugated box (not illustrated) from above and is shipped in this state.

The bottom frame 51 is configured as a skid such that five base frames 511 arranged in parallel in the widthwise direction and four longitudinal frames 512 arranged in parallel in the lengthwise direction so as to intersect over the base frames 511 are joined with a base plate, which is not illustrated. The base frames 511 and the longitudinal frames 512 are composed of structural materials such as channel materials. The stand 54 includes leg parts erected adjacent to the joint between the two base frames 511 and the two longitudinal frames 512 near the center, and a top surface part that fits to the stern bracket 64 and has the same inclination as the transom board of a ship such that the crankshaft of the engine is placed in a horizontal position while the outboard motor 60 is secured.

As illustrated in FIG. 1, the side frame 52 is configured such that a lower frame 521 serving as a fixed part on the bottom frame 51 and an upper frame 522 are bolted to the lower and upper end parts of multiple vertical frames 523, respectively, are welded to the ends of a pair of braces 525 welded together at their central intersection, and are rigidly joined without deformation by fastening a brace 524. The lower frame 521, the upper frame 522, and the brace 524 are composed of L-angle structural materials, and the vertical frames 523 are composed of hat-shaped structural materials.

As illustrated in FIG. 2, the end frame 53 is configured such that the upper parts of a pair of vertical frames 531 are joined via an upper frame 532 and are rigidly joined without deformation by welding a pair of braces 533 welded together at their central intersection. The vertical frames 531 and the upper frame 532 are composed of L-angle structural materials. A reinforcing frame 535 is installed between the side frames 52 and serves as a support structure of an upper cushioning member 45.

As described above, the side frames 52 and the end frames 53 surrounding around the outboard motor 60 fixed to the stand 54 on the bottom frame 51 each have a trussed structure that protects the outboard motor 60 and is strong and rigid enough to be stacked when loaded and stored into a container.

However, medium-sized and large-sized outboard motors are 1.5 to 2 m in overall height and 100 to 350 kg in weight and are supported with a large overhang on the stand 54. In addition, the center of gravity is high relative to the supporting position and is biased toward the engine on the left side of FIG. 1. Moreover, as described above, the packing frame 50 is basically a one-way shipping packing material and is designed to have minimum strength and rigidity required for ordinary loading and unloading operations and transportation.

Thus, when an excessive impact is applied to the packing frame 50 by an external factor during loading and unloading operations and transportation, for example, when a carrier vehicle passes through bumps on a road, e.g., speed bumps without deceleration during land transportation, the outboard motor 60 may swing in the packing frame 50 and come into contact with the packing frame 50. In particular, when the packing frame 50 topples over, it is difficult for the stand 54 to cantilever the outboard motor 60, so that the outboard motor 60 may fall onto the inner surface of the packing frame 50.

Thus, in order to prevent the outboard motor 60 from being damaged when in contact with the packing frame 50, cushioning members 41, 45, and 46 that are adjacent to the outboard motor 60 are provided inside the packing frame 50.

Among the cushioning members, the cushioning member 45 is provided for an upward movement around a cavitation plate when a moment occurs counterclockwise in FIG. 1 due to the biased center of gravity of the outboard motor 60 described above. The cushioning member 46 is provided for a downward movement of a top cowl 62. The cushioning member 46 is fixed on the base plate of the bottom frame 51.

In contrast, the cushioning members 41 are disposed adjacent to the sides of the outboard motor 60 inside the side frames 52 in order to reduce lateral swings of the outboard motor 60 in FIG. 2 and an impact when the outboard motor 60 falls due to the toppling over of the packing frame 50. The cushioning members 41 and the mounting structure will be described below with reference to the accompanying drawings.

(Mounting Structure of Cushioning Member 41)

Figure 3A:
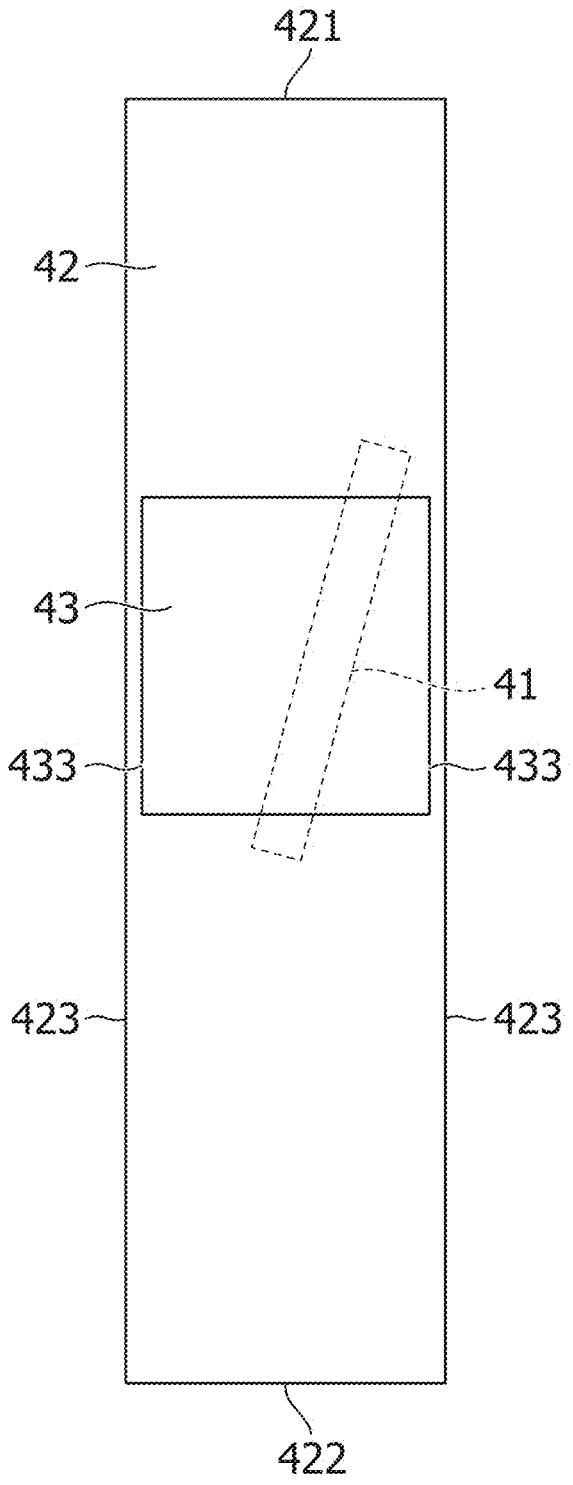
FIG. 3A is a front view illustrating the mounting structure of a cushioning member.
Figure 3B:
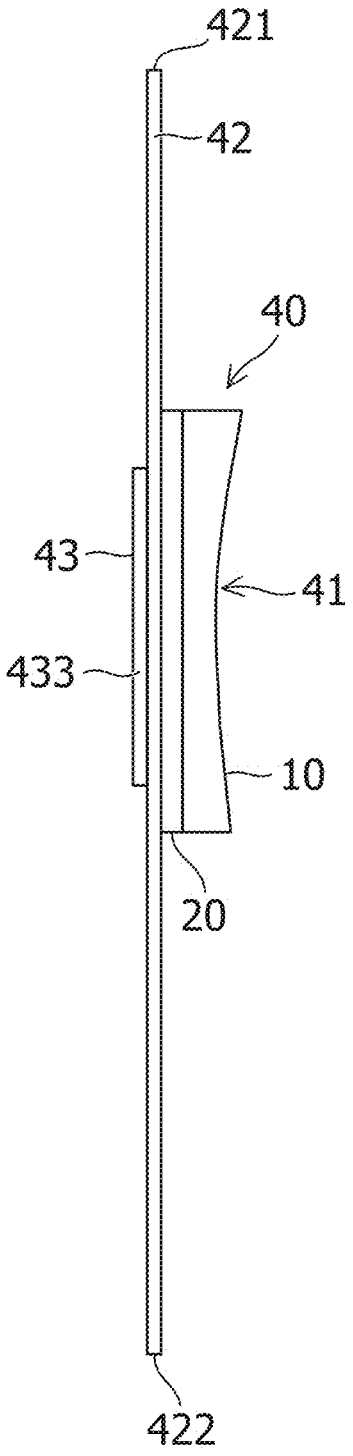
FIG. 3B is a side view illustrating the mounting structure of the cushioning member.

As illustrated in FIGS. 2, 3A, and 3B, the cushioning member 41 includes a first cushioning member 10 having a surface including a curved surface that is formed twodimensionally or three-dimensionally to conform to the shape of the side of the outboard motor 60 near a bottom cowl 61, and a second cushioning member 20 that supports the first cushioning member 10 while being placed in contact with the back side of the first cushioning member 10. The first cushioning member 10 is made of a foam material, and the second cushioning member 20 comprises a corrugated board assembly.

As illustrated in FIG. 1, the cushioning member 41 is joined to the surface of a base part 42 at the bottom of the second cushioning member 20 while being oriented along the shape of the bottom cowl 61 of the outboard motor 60. The base part 42 includes a corrugated cardboard sheet, and an anchor part 43 like a block is joined to the back side of the base part 42. The anchor part 43 includes a laminate of corrugated cardboard sheets, and thus. the base part 42 and the anchor part 43 also have the cushioning function in the thickness direction and constitute a cushioning member assembly 40 with the cushioning member 41.

The cushioning member 41 (cushioning member assembly 40) having such a mounting structure is disposed adjacent to the side of the outboard motor 60 inside the side frame 52 by fitting the anchor part 43 between the two vertical frames 523 such that side edge portions 423 of the base part 42 overlap the inner sides of parts (flange portions) of the two adjacent vertical frames 523 of the side frame 52, and the side edge 433 of the anchor portion 43 is caught between the two vertical frames 523.

The base part 42 has a length corresponding to the length from the upper end to the lower end of the vertical frame 523 in the vertical direction. A lower end 422 of the base part 42 is supported at the inner bottom of the packing frame 50, and an upper end 421 of the base part 42 is in contact with or adjacent to the upper frame 522 in this state. This configuration prevents a displacement of the cushioning members 41 during transportation.

(Assembly Structure of Cushioning Member 41)

An embodiment of the first cushioning member 10 and the second cushioning member 20 that constitute the cushioning member 41 will be described below with reference to the accompanying drawings.

Figure 4:
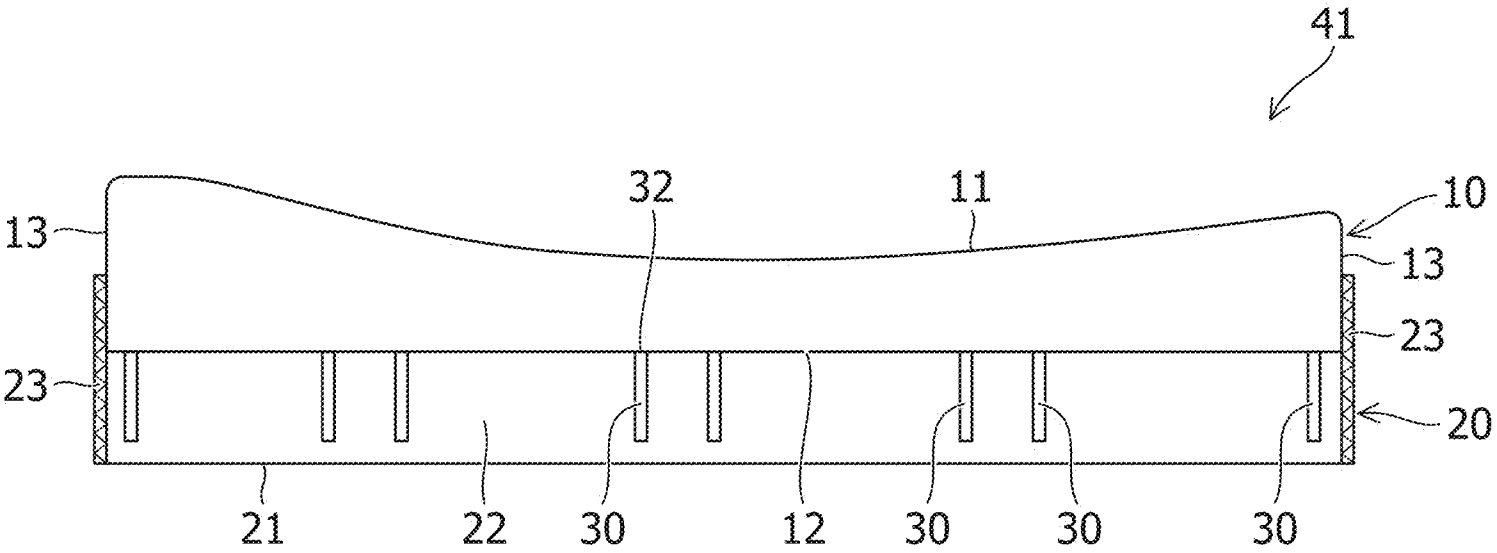
FIG. 4 is a side view illustrating the cushioning member.

As illustrated in FIG. 4, the first cushioning member 10 has a front face 11 including a curved surface conforming to the shape of the side of the outboard motor 60 and a back side 12 having a flat basic shape, and is configured like a long and narrow block extending with a first width w1 in the longitudinal direction. Although a foamed material constituting the first cushioning member 10 is not particularly limited, a foamed material of synthetic resin, e.g., polystyrene foam, may be properly used.

As illustrated in FIG. 4, the first cushioning member 10 has a front face 11 including a curved surface along the shape of the side of the outboard motor 60 and a back side 12 having a flat basic shape, and is configured like a long and narrow block extending with a first width w1 in the longitudinal direction. Although a foam material constituting the first cushioning member 10 is not particularly limited, a foam material of synthetic resin, e.g., polystyrene foam is appropriately usable.

Figure 5A:
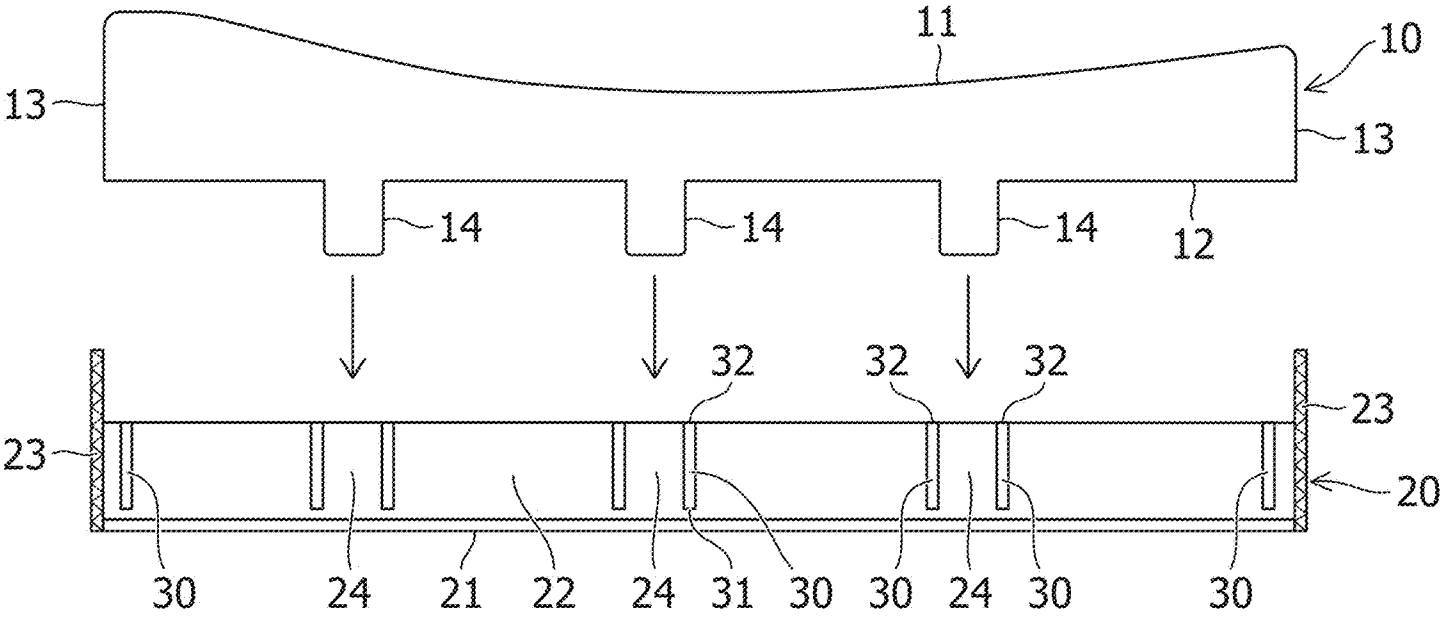
FIG. 5A is a side view illustrating a disassembled state of the cushioning member.
Figure 5B:
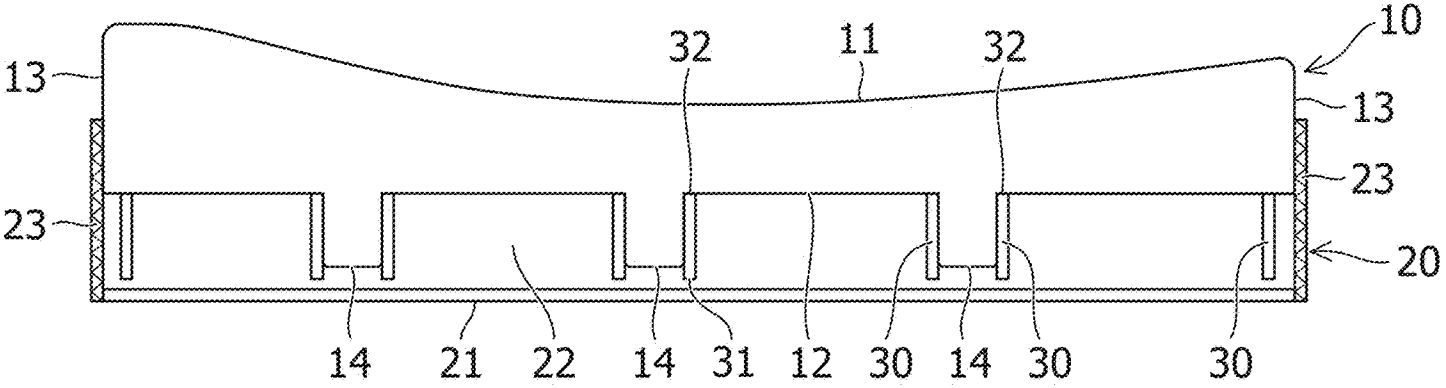
FIG. 5B is a side cross-sectional view illustrating a fit state of the cushioning member.

In a preferred embodiment, as illustrated in FIG. 5A, the first cushioning member 10 has a plurality of leg portions 14 projected at certain intervals on the back side 12 in the longitudinal direction. As illustrated in FIG. 5B, the second cushioning member 20 has a plurality of socket portions 24 formed therein that hold the leg portions 14 of the first cushioning member 10 in a fitted state.

Figure 6A:
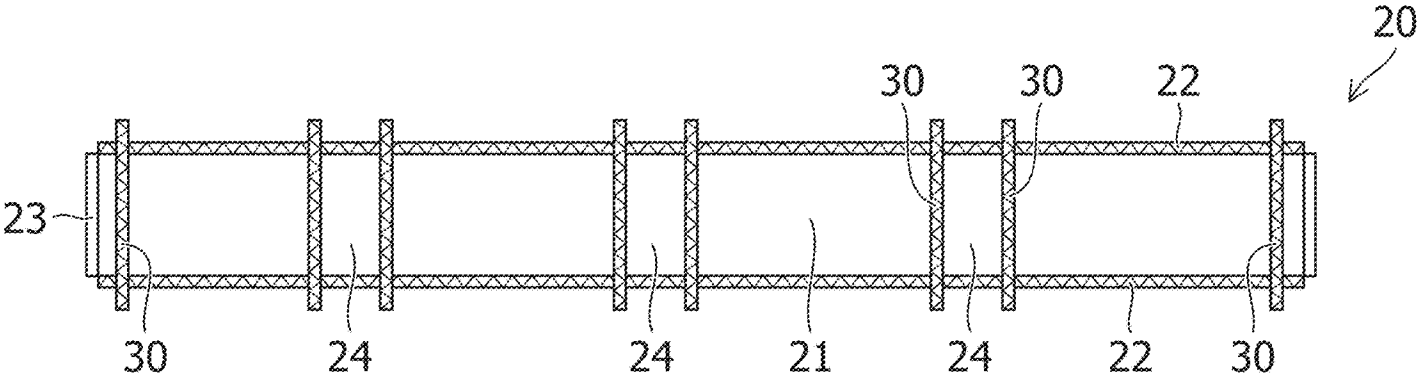
FIG. 6A is a plan view illustrating a second cushioning member.
Figure 6B:
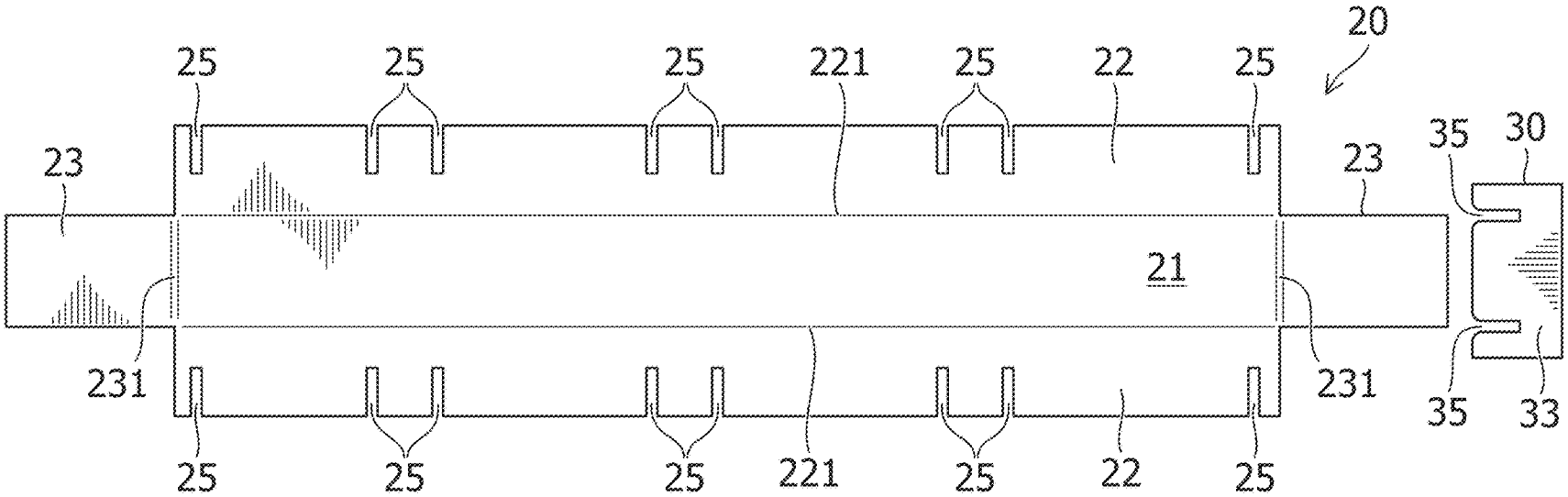
FIG. 6B is a development view illustrating the second cushioning member.

As illustrated in FIG. 6B, the second cushioning member 20 is formed by a corrugated cardboard blank having a bottom wall 21, a pair of side walls 22, and a pair of end flaps 23 such that the width direction orthogonal to the longitudinal direction serves as a flute direction. In other words, folding lines 221 and 231 (creases, scores) are processed on both sides and both ends of the bottom wall 21, and the bottom wall 21 connects to the side walls 22 and the end flaps 23 via the folding lines. On the edges of the side walls 22, slits 25 to be engaged with engagement tabs 33 of bridge portions 30 are provided.

Figure 7:
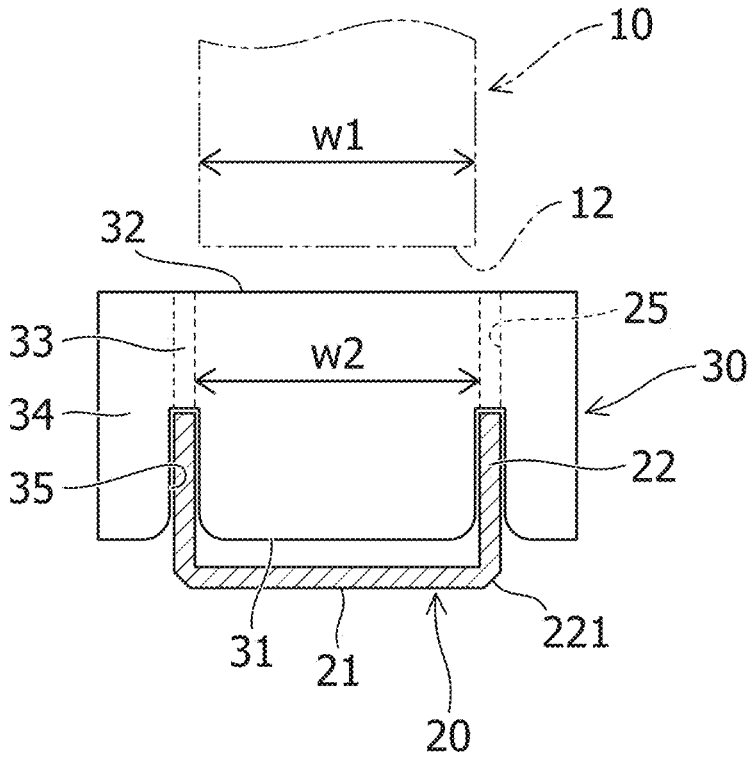
FIG. 7 is a cross-sectional view illustrating the principal part of the cushioning member in a disassembled state.

The plurality of bridge portions 30 are formed by corrugated cardboard blanks identical in shape such that a direction from an upper end 32 to a lower end 31 serves as the flute direction. At positions corresponding to the engagement tabs 33 on both sides of the lower end 31, engagement slots 35 are provided. The engagement slots 35 are engaged with portions under the slits 25 of the side walls 22 toward the engagement tabs 33 near the upper end 32. As illustrated in FIG. 7, extended portions 34 are formed so as to extend laterally through the engagement tabs 33. Furthermore, at an introducing portion on the lower end of the engagement slot 35, an extended opening portion is formed to facilitate engagement with the slit 25.

Thereafter, the folding lines 221 on both sides of the bottom walls 21 are folded, the bottom wall 21 and the pair of side walls 22 on both sides form a channel shape extending in the longitudinal direction with a second width w2, and the engagement slots 35 of the bridge portions 30 are engaged into the respective slits 25 to engage the engagement tabs 33, so that, as illustrated in FIG. 6A, the pair of side walls 22 is bridged by the bridge portions 30 and the adjacent three pairs of the bridge portions 30 and the side walls 22 form the three socket portions 24 that hold the leg portions 14 of the first cushioning member 10.

As illustrated in FIGS. 5 and 7, the engagement tabs 33 of the bridge portion 30 are engaged into the slits 25 of the side walls 22. In this state, a clearance is formed between the lower end 31 of the bridge portion 30 and the bottom wall 21. In other words, the dimensions of the height from the upper end 32 to the lower end 31 of the bridge portion 30 and the depth of the engagement slot 35 (the length of the engagement tab 33 in the engaging direction) are determined so as to form a clearance between the bridge portion 30 and the bottom wall 21 in an engaged state.

As illustrated in FIG. 5, the leg portions 14 of the first cushioning member 10 are inserted and held in the socket portions 24 of the second cushioning member 20 until the upper ends of the bridge portions 30 come into contact with the back side 12 of the first cushioning member 10. In this state, a clearance is formed between the end of the leg portion 14 and the bottom wall 21. In other words, the dimensions of the leg portion 14 are determined such that a clearance is left between the leg portion 14 and the bottom wall 21.

Figure 9A:
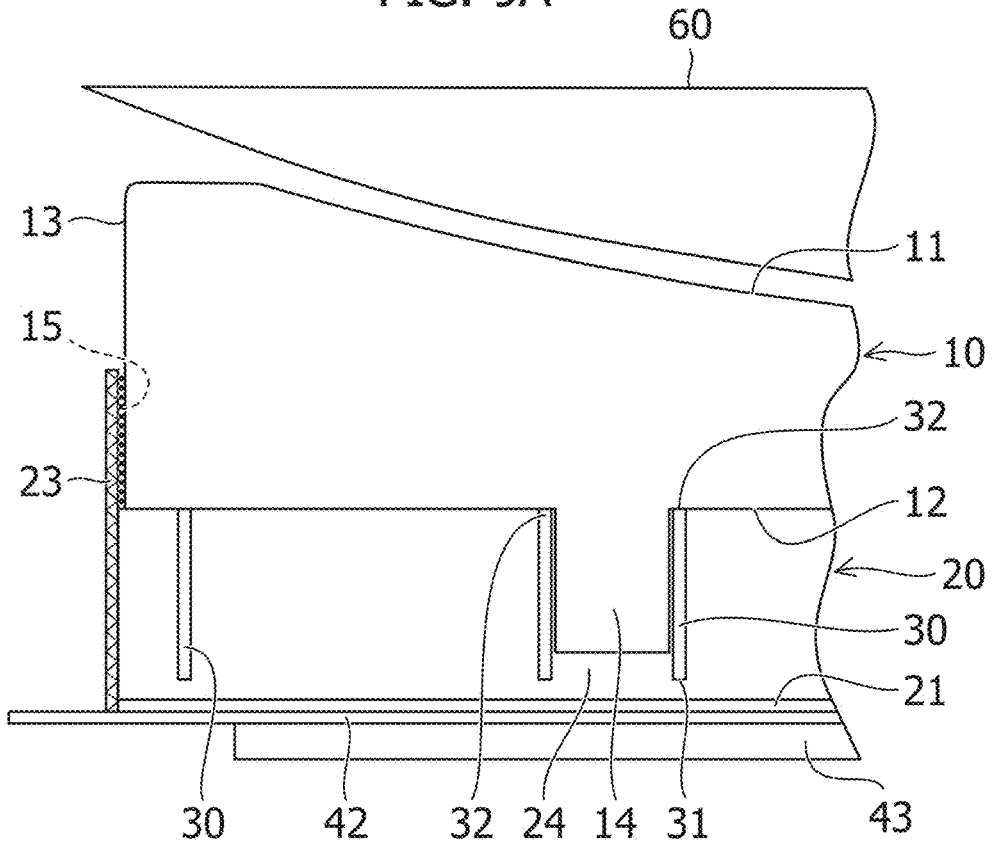
FIG. 9A is a side view illustrating the principal part of the cushioning member.
Figure 9B:
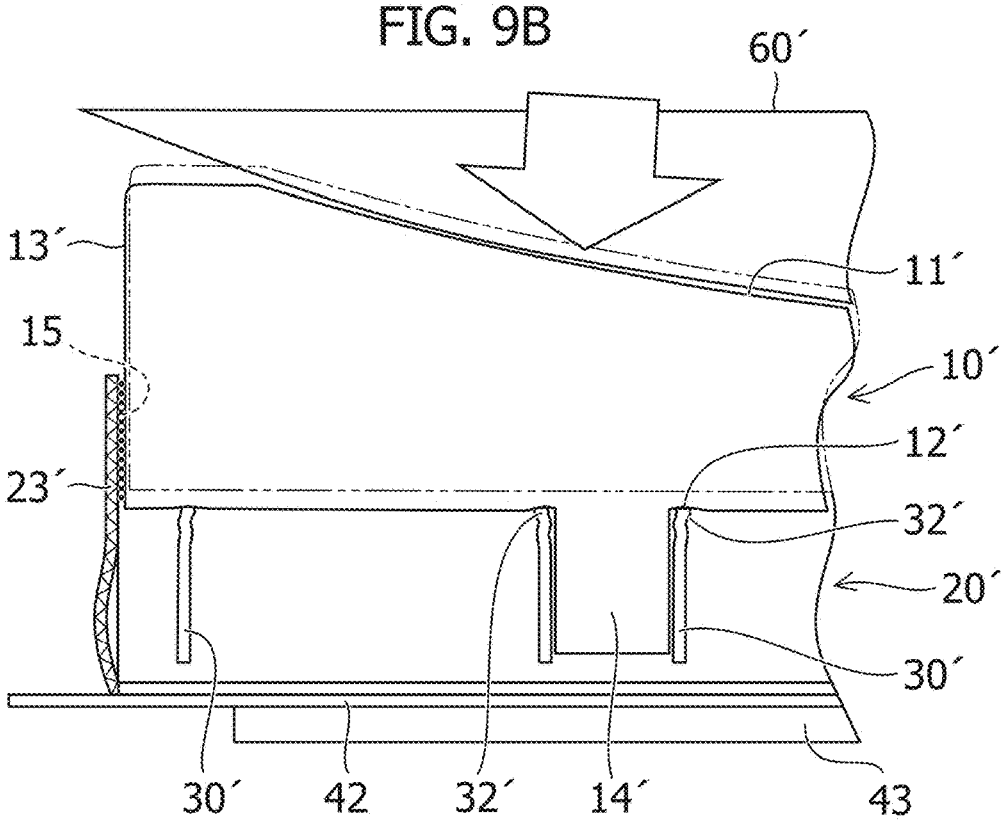
FIG. 9B is a side view illustrating the principal part of the cushioning member in a deformed state.

In this embodiment, the leg portions 14 of the first cushioning member 10 are held in the socket portions 24 of the second cushioning member 20, so that the first cushioning member 10 and the second cushioning member 20 are integrated. Thus, no other joining or engagement is required between the first cushioning member 10 and the second cushioning member 20. As illustrated in FIG. 9A, the end flap 23 of the second cushioning member 20 may be joined 15 on an end face 13 of the first cushioning member 10. The end flap 23 is oriented with the flute direction in the width direction, and thus can be easily deformed in the height direction as illustrated in FIG. 9B. The end flap 23 does not interfere with elastic deformation of the first cushioning member 10 and plastic deformation of the second cushioning member 20 (bridge portions 30).

(Impact Absorbing Effect of Cushioning Member Assembly 40)

Figure 8:
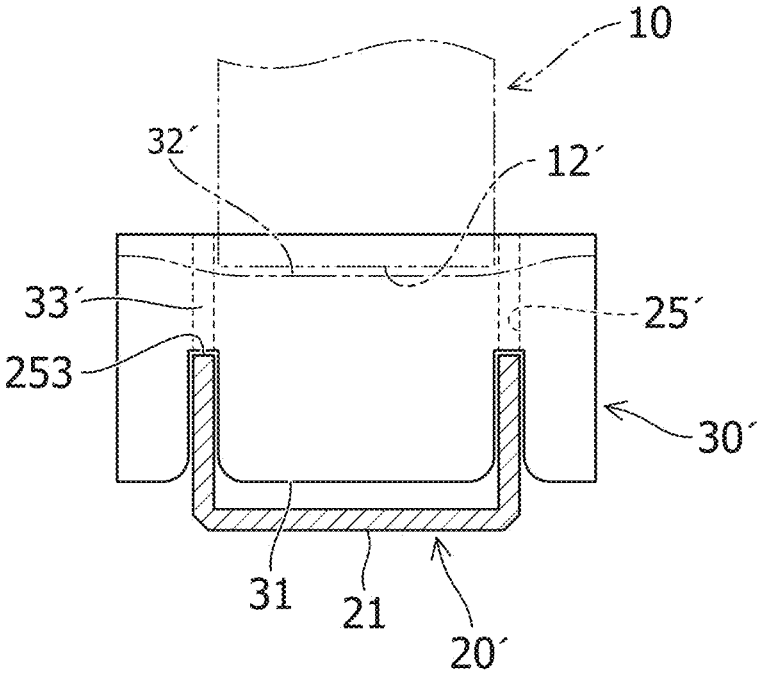
FIG. 8 is a cross-sectional view illustrating the principal part of the cushioning member in a deformed state.

With this cushioning structure (cushioning member assembly 40), when the packing frame 50 falls sideways and the outboard motor 60 falls laterally in the packing frame 50 due to an external factor during transportation of the outboard motor 60 (packing frame 50) or loading and unloading operations, as illustrated in FIGS. 8 and 9B, the first cushioning member 10, the second cushioning member 20, the base part 42, and the anchor part 43 (cushioning member assembly 40) are located under an outboard motor 60', so that an impact load from the outboard motor 60' is applied to a front face 11' of a first cushioning member 10', the first cushioning member 10' is pressed downward while being partially subjected to elastic deformation, and bridge portions 30' of a second cushioning member 20' are plastically deformed from an upper end 32' (first step).

Furthermore, engagement tabs 33' of the bridge portions 30' and slits 25' and slit bottoms 253 of the side walls 22 are plastically deformed, and the bridge portions 30' are moved downward. Thus, before the bridge portions 30' are crushed, leg portions 14' of the first cushioning member 10' are placed onto the bottom wall 21 of the second cushioning member 20, the elastic deformation of the leg portions 14' is started, and the bridge portions 30' are plastically deformed at the same time (second step).

Thereafter, the bridge portions 30' of the second cushioning member 20 are crushed by the load of the outboard motor 60', and the body and the leg portions 14' of the first cushioning member 10' are elastically and partially plastically compressed. The falling of the outboard motor 60' is ended in a state in which the static load of the outboard motor 60' is received by the first cushioning member 10', the bottom wall 21 of the second cushioning member 20, the base part 42, and the anchor part 43 (third step).

In reality, the foregoing process is terminated nearly in a moment. The elastic deformation of the first cushioning member 10 made of a foam material and the plastic deformation of the second cushioning member 20 including a corrugated board assembly have different deformation patterns, the elastic compression of the first cushioning member 10 is delayed by, in particular, the plastic deformation of the second cushioning member 20, and the plastic deformation of the second cushioning member 20 is decelerated. Such synergistic action and the cushioning effect of the third cushioning member (base part 42, anchor part 43) located under the cushioning members can avoid breakage of the first cushioning member 10 and maximize an impact absorbing effect obtained by the elastic deformation of the first cushioning member 10 and the plastic deformation of the second cushioning member 20, thereby advantageously preventing damage to the outboard motor 60.

In the foregoing process, the first cushioning member 10 enters a channel shape defined between the side walls 22 of the second cushioning member 20, and the sides of the first cushioning member 10 are guided by the side walls 22. In addition, the leg portions 14 of the first cushioning member 10 are guided by the socket portions 24, each being formed between the bridge portions 30 of the second cushioning member 20. Thus, a displacement between the first cushioning member 10 and the second cushioning member 20 is prevented, the elastic deformation of the body and the leg portions 14 of the first cushioning member 10 is securely induced between the side walls 22 of the second cushioning member 20, and an impact load applied to the first cushioning member 10 is securely input to the bridge portions 30 of the second cushioning member 20, thereby obtaining an impact absorbing effect according to the design.

In addition, the anchor part 43 constituting the mounting structure of the cushioning member 41 is fit between the two vertical frames 523 of the packing frame 50 to prevent displacement of the cushioning member 41 and is located to fill a gap formed between a corrugated box covering outside the packing frame 50 and the base part 42 overlapping the inner side of the vertical frames 523. This structure provides a flat support base for the base part 42 and advantageously ensures the progress of the cushioning process of the first cushioning member 10 and the second cushioning member 20.

The configuration of the base part 42 and the anchor part 43 can improve the degree of flexibility in the layout of the cushioning members 41. For example, the cushioning member 41 is diagonally placed on the front face of the base part 42 along the bottom cowl 61, which is a high-strength part of the outboard motor 60, thereby maximizing the cushioning effect for the outboard motor 60. This configuration is also advantageous when the cushioning member 41 is located over a part including the vertical frame 523 and a part not including the vertical frame 523.

In addition, the base part 42 and the anchor part 43 that constitute the third cushioning member are made of corrugated paper, which is a recyclable resource, like the second cushioning member 20. Thus, as compared with a case in which a cushioning member is entirely made of a foam material, this configuration has the advantage of reducing the amount of foam material used, which will become industrial waste after use.

The embodiment of the present invention is described in the foregoing description. The present invention is not limited to the embodiment and can be modified and changed in various ways within the scope of the present invention.

For example, in the case of the foregoing embodiments, the three leg portions 14 are formed on the back side 12 of the first cushioning member 10. The number of leg portions 14 may be two or four or more. Moreover, if a clearance between the end of the leg portion 14 and the bottom wall 21 is too great, the amount of elastic deformation of the leg portion 14 decreases accordingly. Thus, the clearance is equal to or less than a half of the depth of the socket portion 24 or preferably equal to or less than one third of the depth of the socket portion 24.

Furthermore, in the foregoing embodiments, the width of the leg portion 14 in the longitudinal direction of the first cushioning member 10 is one fourth of the space of a section having no leg portions, that is, the ratio of the leg portion and the space is, but is not limited to, 1 to 4. Moreover, in the illustrated example, a leg portion (foam material portion) may be added to a section having no leg portions. However, if the ratio of the space is too great, the leg portion may have insufficient elasticity. Conversely, when the ratio of the leg portion (foam material portion) is too great, the amount of foam material used increases accordingly, and also the ratio of elastic deformation increases in the step of developing plastic deformation and elastic deformation in parallel (second step), so that the contribution ratio of the cushioning effect obtained by the plastic deformation of the bridge portions may decrease.

Moreover, the back side 12 of the first cushioning member 10 may be flattened without providing the leg portions 14 on the back side 12 of the first cushioning member 10. In this case, as illustrated in FIG. 9A, the end flap 23 of the second cushioning member 20 has the joint 15 on the end face 13 of the first cushioning member 10, so that the first cushioning member 10 can be held by the second cushioning member 20.

In the foregoing embodiments, the upper ends 32 of the bridge portions 30 of the second cushioning member 20 are aligned with the upper ends of the side walls 22. The upper ends of the side walls 22 may protrude upward from the upper ends 32 of the bridge portions 30. Such a protrusion does not contribute to reduction in manufacturing cost, but advantageously yields the effect of guiding the first cushioning member 10 into the channel of the second cushioning member 20 to prevent displacement in the embodiment not including the leg portions 14.

In the foregoing embodiments, the cushioning member 41 is inclined along the bottom cowl 61, which is a high-strength part of the outboard motor 60, and is located midway between the vertical frames 523. The cushioning member 41 may be located inside the vertical frame 523 near the top cowl 62 on the left side of FIG. 1 or may be added.

In the foregoing embodiments, the outboard motor 60 is a packed object. The cushioning members 41 according to the present invention can also be implemented when another packed object, e.g., a motorcycle, is transported with insufficient self-support like an outboard motor while being secured in an upright position in the packing frame.

REFERENCE SIGNS LIST

10 First cushioning member (foam material)
11 Front face
12 Back side
20 Second cushioning member (corrugated board assembly)
21 Bottom wall
22 Side wall
30 Bridge portion
31 Lower end
32 Upper end
33 Engagement tab
40 Cushioning member assembly
41 Cushioning member
42 Base part
43 Anchor part
60 Outboard motor (packed object)
50 Packing frame
51 Bottom frame
52 Side frame
53 End frame
54 Stand

The invention claimed is:

1. A cushioning structure disposed inside a crate part of a packing frame surrounding a packed object, the cushioning structure being provided to protect the packed object secured on an inner bottom of the packing frame, the cushioning structure comprising:

a first cushioning member made of a foam material having a front face disposed adjacent to a side of the packed object;

a second cushioning member comprising a corrugated board assembly that supports the first cushioning member while being in contact with a back side of the first cushioning member;

a base part made of corrugated paper that is located to overlap inner sides of at least parts of two adjacent vertical frames among a plurality of vertical frames constituting the crate part of the packing frame, and has a front face to which a bottom of the second cushioning member supporting the first cushioning member is joined; and an anchor part made of corrugated paper that is projected on a back side of the base part and is fit between the two vertical frames to fix the base part to the crate part.

2. The cushioning structure according to claim 1, wherein the cushioning structure is configured such that the base part has a length corresponding to a length from an upper end to a lower end of the two vertical frames in a vertical direction, and the base part has a lower end supported on the inner bottom of the packing frame.

3. The cushioning structure according to claim 1, wherein the anchor part includes a corrugated board laminate.

4. The cushioning structure according to claim 1, wherein the first cushioning member has an elongated shape extending & with a first width-in a longitudinal direction with a first width, and the second cushioning member has a bottom wall that forms a channel extending in the longitudinal direction with a second width larger than the first-width, a pair of side walls connected on both sides of the bottom wall via folding portions, and a plurality of bridge portions that bridge the pair of side walls at multiple points spaced at certain intervals in the longitudinal direction, and forms a channel extending in the longitudinal direction with a second width larger than the first width, wherein the first cushioning member is fixed on the second cushioning member while being in contact with upper ends of the bridge portions-in-a-range of the channel.

5. The cushioning structure according to claim 4, wherein the bottom wall and the pair of side walls of the second cushioning member are formed by a first corrugated cardboard blank such that a flute direction of the first corrugated cardboard blank is orthogonal to the longitudinal direction, and the plurality of bridge portions are formed by a plurality of second corrugated cardboard blanks such that a direction from the upper end to a lower end serves as a flute direction.

6. The cushioning structure according to claim 1, wherein the packed object is an outboard motor, and the packing frame is provided with a bracket on the inner bottom of the packing frame, and the bracket is configured to fix a stern bracket of the outboard motor-being fixed on a bracket with a propulsion direction of the outboard motor facing downward-by fastening a stem bracket of the outboard motor to the bracket provided on the inner bottom of the packing frame, and the second cushioning member supporting the first cushioning member is diagonally positioned on the front face of the base part obliquely to an edge of the base part to be along a bottom cowl part of the outboard motor.

* * * * *